US005765925A

United States Patent [19]

Kondo et al.

[11] Patent Number: 5,765,925

[45] Date of Patent: Jun. 16, 1998

[54] TUNNEL BORING MACHINE FOR HARD GROUND AND SOFT GROUND

[75] Inventors: Yasunori Kondo, Kakogawa; Yuko Fukuda; Takato Yoshida, both of Kobe, all of Japan

[73] Assignee: Kawasaki Jukogyo Kabushiki Kaisha, Kobe, Japan

[21] Appl. No.: 630,475

[22] Filed: Apr. 10, 1996

[30] Foreign Application Priority Data

May 12, 1995 [JP] Japan ..... 7-138715

[51] Int. Cl.[6] ..... E21D 9/06

[52] U.S. Cl. ..... 299/31; 405/141

[58] Field of Search ..... 299/31, 33; 405/138, 405/141

[56] References Cited

U.S. PATENT DOCUMENTS

| | | | |
|---|---|---|---|
| 4,043,137 | 8/1977 | Jutte et al. | 299/31 X |
| 4,494,799 | 1/1985 | Snyder | 299/31 |
| 4,637,657 | 1/1987 | Snyder | 299/31 |
| 4,804,295 | 2/1989 | Kondo | 299/31 X |

FOREIGN PATENT DOCUMENTS

| | | | |
|---|---|---|---|
| B2-62-32319 | 7/1987 | Japan . | |
| A-5-187195 | 7/1993 | Japan . | |
| 538133 | 3/1977 | U.S.S.R. | 299/31 |

*Primary Examiner*—David J. Bagnell
*Attorney, Agent, or Firm*—Oliff & Berridge, PLC

[57] ABSTRACT

A tunnel boring machine for boring a tunnel through hard and soft grounds includes a front body, a cutter head mounted to the front body and having a cutter for boring a hard round, and a drive unit rotatably supporting the cutter head for driving the cutter head. A main beam is operatively connected to the cutter head drive unit and extends rearward therefrom. A gripper body is supported by a rear end portion of the main beam to be slidable in an axial direction thereof and is provided with a main gripper to be movable along an radial direction of the main beam. A first thrust jack is mounted to be fitted between the main gripper and the main beam for advancing the cutter head and the cutter head drive unit. A shield shell is disposed so as to surround the cutter head drive unit. A second thrust jack is disposed in the shield shell, and a front gripper is mounted to the shield shell to be movable out of and into the shield shell.

10 Claims, 8 Drawing Sheets

TUNNEL BORING MACHINE FOR HARD GROUND AND SOFT GROUND

BACKGROUND OF THE INVENTION

The present invention relates to a tunnel boring machine capable of not only boring a hard ground, for example a rock-bed, but also boring a soft ground.

As a conventional tunnel boring machine for boring a tunnel, there are publicly known such machines as disclosed in Japanese Patent Publication (KOKOKU) No. SHO 62-32319 and Japanese Patent Laid-Open Publication (KOKAI) No. HEI 5-187195. The tunnel boring machines disclosed in these publications are mainly of a beam type (or an open type) and a full-shield type, respectively.

The tunnel boring machine of a beam type, as shown in FIG. 6, has a beam 32 which is provided at its front end with a cutter head 31. A pair of front and rear grippers 33(33*a*, 33*b*) are slidably provided along an axial direction of the beam 32, the pair of front and rear grippers 33 being connected with each other with a space in the axial direction. Each of the pair of front and rear grippers 33 can extend and shrink along a direction crossed to the axial direction by, for example, hydraulic pressure. The rear gripper 33*b* is connected with the beam 32 by means of a thrust jack 36. A drive unit 37 is provided at the rear end of the beam 32 for rotating the cutter head 31 rotatively supported by a thrust bearing 34 through a rotational shaft 38 which penetrates the central portion of the beam 32 along the axial direction thereof. A support member 39 which supports the beam 32 is provided at the rear end of the beam 32 to be shrinkable downward.

In the tunnel boring work, the front and rear grippers 33*a* and 33*b* are extended respectively and pressed against a tunnel pile wall so as to get reaction force caused by the advancing of the boring machine in the boring work, and while rotating the cutter head 31, a thrust force produced by shrinking the thrust jack 36 is given to the boring machine thereby advancing the boring machine to bore the tunnel. After boring the tunnel by a predetermined distance, the front gripper 33*a* and the rear gripper 33*b* are shrunken and the thrust jack 36 is extended so that the front gripper 33*a* and the rear gripper 33*b* advance along the axial direction. A tunnel can be bored by the boring machine by repeating the boring workings described above.

On the other hand, the tunnel boring machine of a full-shield type, as shown in FIG. 7, has a front body 45, a rear body 48 and a middle body 49 which interconnects the front body 45 and the rear body 48 through a thrust jack 50. The front body 45 has a tubular shield shell 45*a* which is provided at its front end with a cutter head 41. A driving unit 43 is provided in the tubular shield shell 45*a*. The front body 45 also has a front gripper 44 mounted on the surface thereof so as to extend and shrink along a radial direction crossed to the axial direction of the front body 45. The rear body 48 has a tubular shield shell 48*a*. A shield jack 46 is mounted on the inner surface of the rear body 48 so as to extend and shrink along the axial direction of the rear body 48. The rear body 48 also has a main gripper 47 mounted on the surface thereof, which extends and shrinks along to the radial direction thereof. The middle body 49 is constructed as a double tubular structure to be slidable along the axial direction thereof.

In the boring work of the tunnel in the hard ground, for example a rock-bed, the main gripper 47 is extended and pressed against the tunnel pile wall so as to get reaction caused by the advancing of the boring machine in the boring operation. While rotating the cutter head 41 by means of the drive unit 43, a thrust forth produced by shrinking the thrust jack 36 is given to the front body 45, thus the front body 45 advancing to bore the tunnel. After boring the tunnel by a predetermined distance, the front gripper 44 is extended and the main gripper 47 is shrunken. The thrust jack 50 is then shrunken so as to draw the rear body toward the front body 45. A tunnel in the hard ground can be bored by the boring machine by repeating the boring operation described above.

On the other hand, in the tunnel boring operation to the soft ground, a surrounding wall of a segment is constructed near the rear side of the rear body 48 by an elector, not shown. The rear end of the shield jack 46 is disposed so as to abut against the end surface of the segment wall, and while rotating the cutter head 41 by the driving unit 43, a thrust forth produced by extending the shield jack 46 is given to the entire portions of the boring machine (the front body 45, the middle body 49 and the rear body 48). As a result, the boring machine can advance entirely to bore the tunnel. The thrust jack 50 is kept to be shrunken during this tunnel boring working in the soft ground.

However, the conventional tunnel boring machines described above involve or provide some technical problems, which are to be solved or improved, in the following points.

In the tunnel boring machine of a beam type, when the boring machine encounters to a soft ground and enters therein, it may be impossible to bore the tunnel because a boring reaction force is not produced by the front and rear grippers.

Moreover, in the boring machine of a beam type, since the main important devices, such as the front and rear grippers, the thrust jack, the drive unit, and so on are exposed, the main devices are buried with an earth and sand caused by collapse of a ground pile or other similar accidents especially at the boring working in the soft ground, and there may cause a case where the main devices are not worked in normal. In a modification, one boring machine of a beam type has a roof mounted on the rear upper portion of the cutter head. However, it is impossible to prevent, by merely the roof, the collapse of the ground pile or other similar accidents and the invasion of the earth and sand into the main devices, providing the same problems mentioned above.

On the other hand, in the tunnel boring machine of a full-shield type, it will be required to restore a ground pile, and when the restoration of the ground pile is carried out, it may be desirable to spray a resin or a cement to the ground pile or to drive a lock bolt into the ground pile as soon as the tunnel is bored by the cutter head of the boring machine. However, since the boring machine has usually long length along its axial direction and the boring machine is covered with the shield-shell throughout the entire length thereof, it requires much time till the restoration of the ground pile starts after boring the tunnel. Therefore, the collapse of the ground pile progresses before the restoration of the ground pile is carried out, thus being difficult to carry out the restoration of the ground pile.

SUMMARY OF THE INVENTION

An object of the present invention is to substantially eliminate defects or drawbacks encountered in the prior art described above and to provide a tunnel boring machine capable of boring a tunnel not only in a hard ground, for example rock-bed, but also in a soft ground.

Another object of the present invention is to provide a tunnel boring machine which can carry out a restoration of a ground pile at a place adjacent to a working face of the cutter head.

A further object of the present invention is to provide a tunnel boring machine having the whole structure simpler than the whole structure of a conventional tunnel boring machine and equipped with main devices preferably protected by a shield-shell.

These and other objects can be achieved according to the present invention by providing a tunnel boring machine for boring a tunnel to a ground comprising: p1 a front body; p1 a cutter head mounted to the front body and having cutter means for boring a hard ground; p1 a drive unit rotatably supporting the cutter head for driving the cutter head; p1 a main beam operatively connected to the cutter head drive unit and extending rearward therefrom; p1 a gripper body supported by a rear end portion of the main beam to be slidable in an axial direction thereof and provided with a main gripper to be movable along an radial direction of the main beam; p1 a first thrust jack mounted to be fitted between the main gripper and the main beam for advancing the cutter head and the cutter head drive unit; p1 a shield shell disposed so as to surround the cutter head drive unit; p1 a second thrust jack disposed in the shield shell; and p1 a front gripper mounted to the shield shell to be movable out of and into the shield shell.

In preferred embodiments, the tunnel boring machine may further comprises a spherical bearing unit provided in the gripper body to allow the main beam to be swingable in every directions, and a torque jack mounted to be fitted between the gripper body and the spherical bearing unit for sliding the main beam in a vertical direction.

The front gripper is disposed on each side portion of the shield shell. The front gripper is provided with a shoe and a gripper jack for moving the shoe outward the shield shell.

A plurality of second thrust jacks are disposed in the shield shell in a circumferential direction thereof with space from each other. The main beam has a tapered configuration gradually reduced from the front body. The main gripper is provided with a gripper shoe and a gripper jack for moving the gripper shoe in a radial direction of the gripper body.

A ring member is provided for the main beam and an erector means is disposed along the ring body to be rotatable in a circumferential direction thereof.

According to the tunnel boring machine of the characters described above, when the tunnel boring work is done to the hard ground, for example a rock-bed, the gripper body is fixed by the main gripper, and the first thrust jack is extended with the cutter head being rotated by means of the driving unit so as to bore the tunnel. After boring the tunnel by a predetermined distance, the shield shell is fixed by the front gripper and the main gripper is shrunken, the shrinkage of the first thrust jack making the gripper body draw in front along the axial direction of the main beam. As a result, it becomes possible for the boring machine to bore the tunnel. After that, the described boring working will be repeated.

On the other hand, when the tunnel boring work is done to the soft ground, the front gripper and the main gripper are shrunken, and a reaction member is constructed by, for example, an erector. The second thrust jack is urged to the reaction member. When the cutter head is rotated by the driving unit, a thrust forth produced by extending the thrust jack is given to the shield shell. As a result, the shield shell advances so as to bore the tunnel by the cutter head. As described above, according to the present invention, since the length of the shield shell extending rearward from the cutter head is short, a supporting and protecting member is constructed near a cutter blade of the cutter head, and the ground pile (the tunnel pile wall) is covered with the supporting and protecting member as soon as the tunnel is bored by the cutter head. Accordingly, the collapse of the ground pile is able to be surely prevented and principal devices, which are exposed, such as main gripper, first thrust jack and so on, are not buried with the earth and sand. In addition, since the cutter head drive devices, such as the cutter head driving unit, a bearing, a shield jack and so on are covered with the shield shell, the cutter head driving devices are prevented from the invasion of the earth and sand. Moreover, since the entire structure of the tunnel boring machine of the present invention is simpler than the entire structure of a conventional tunnel boring machine of the full-shield type, the maintenance of the tunnel boring machine is easy, thus being economical of the time and labor of the maintenance thereof.

Furthermore, by adjusting the extending strokes of both sides of the torque jacks so as to rotate the main beam along the circumference direction, the rolling of the tunnel boring machine which is caused by the boring work can be effectively amended. It is possible to move the main beam only upwards and downwards against the gripper body via the spherical bearing unit by adjusting both sides of the torque jacks with the same extending stroke. In addition, the rotation torque caused by rotating the cutter head can be supported with gripper body via the main body.

BRIEF DESCRIPTION OF THE DRAWINGS

The present invention will be readily understood through the following description by way of the accompanying drawings illustrating a preferred embodiment of the invention.

In the accompanying drawings.

DESCRIPTION OF THE PREFERRED EMBODIMENT

A preferred embodiment of the present invention will be described hereunder with reference to the illustration of the drawings.

Figure 1A:
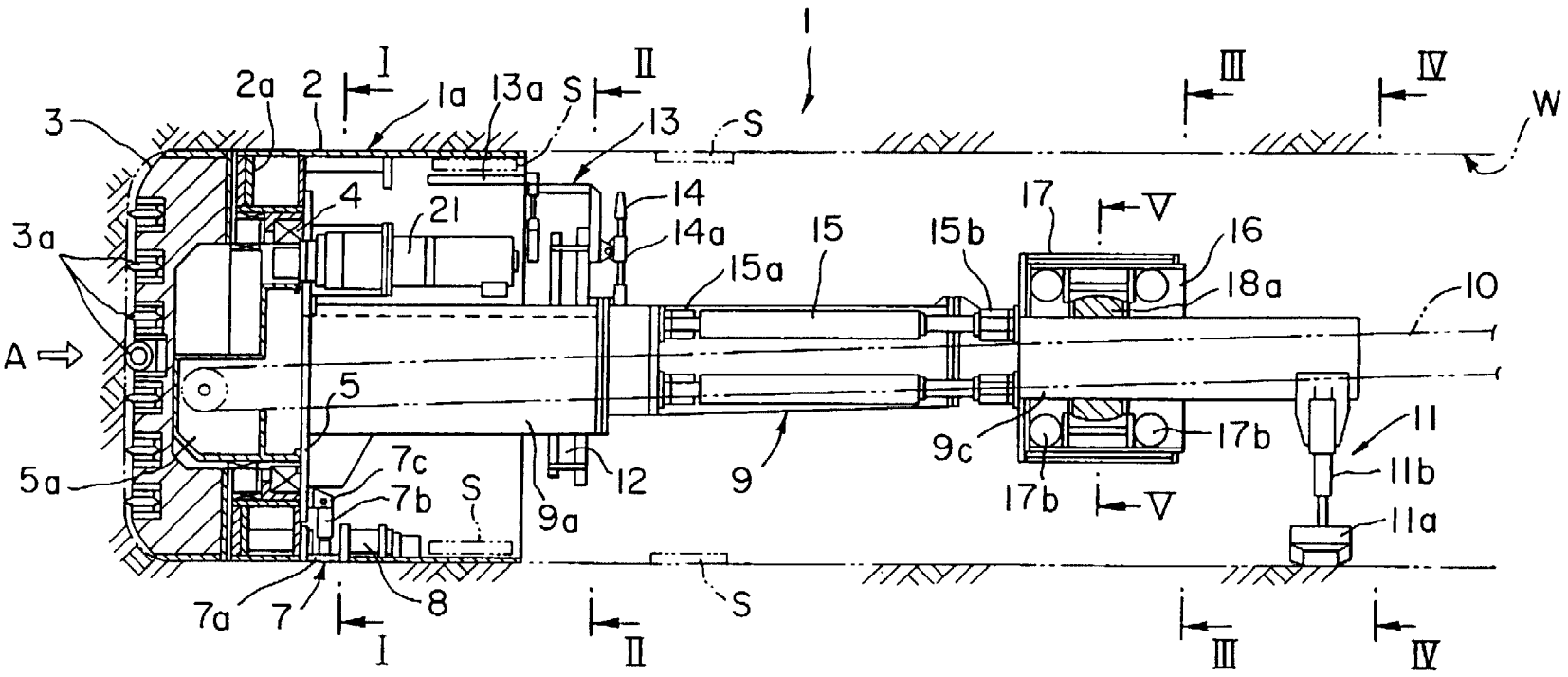
FIG. 1A is a schematic side view showing a structure of a tunnel boring machine according to an embodiment of the present invention.
Figure 1B:
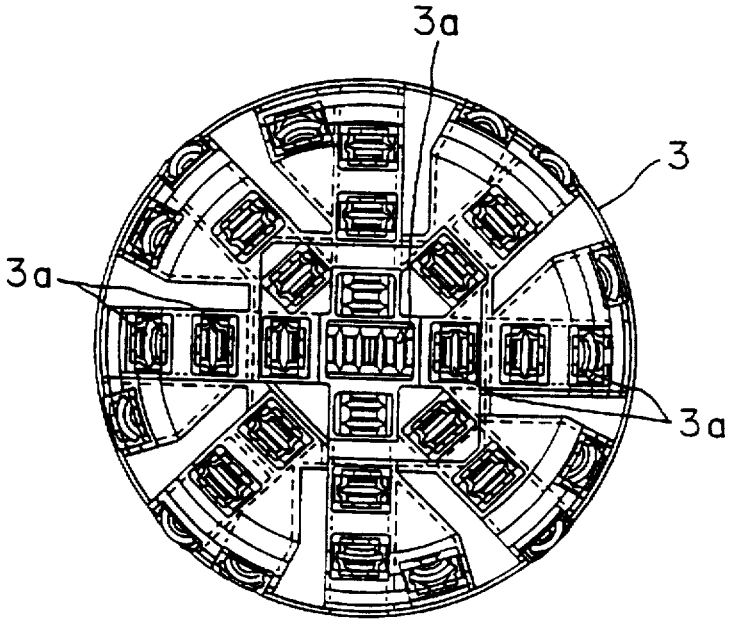
FIG. 1B is a front view showing a cutter head of the tunnel boring machine seen from a direction of arrow A of FIG. 1A.

Referring to FIG. 1A, a tunnel boring machine 1 has a front body 1*a*, the outer periphery of which is covered with a tubular shield shell 2 as shown in FIG. 2. A cutter head 3 having a plurality of roller cutter 3*a* for boring rock-bed is rotatably mounted at the end surface of the front body 1*a* via a bearing 4 (see also FIG. 1B). The bearing 4 is mounted on a bulk head 5. The front body 1*a* is also provided with a drive unit 21 for rotating the cutter head 3, and the front end of the drive unit 21 is secured to the bulk head 5. The bulk head 5 is composed of a circular plate, the outer periphery of which is mounted on an annular frame 2*a* by means of screw or other similar members, the annular frame 2*a* being provided at the front portion of the shield shell 2. A cutter chamber 5*a* is formed in a space between the bulk head 5 and the cutter head 3 in front of the bulk head 5. That is, the front body 1*a*, as described above, has a cutter head drive mechanism which is provided with the bearing 4 and the driving unit 21, and the tubular shield shell 2 is disposed so as to completely cover the periphery of the cutter head driving mechanism.

Figure 2A:
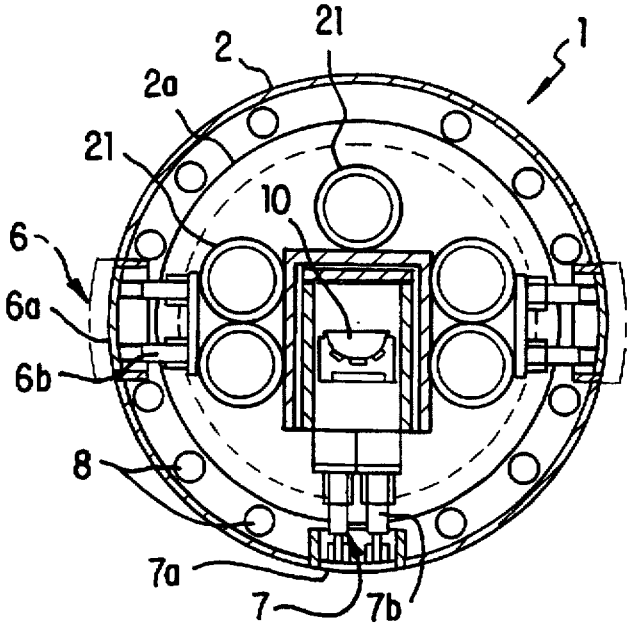
FIG. 2A is a cross-sectional view, left side half part of which is taken along the line I—I of FIG. 1.
Figure 2B:
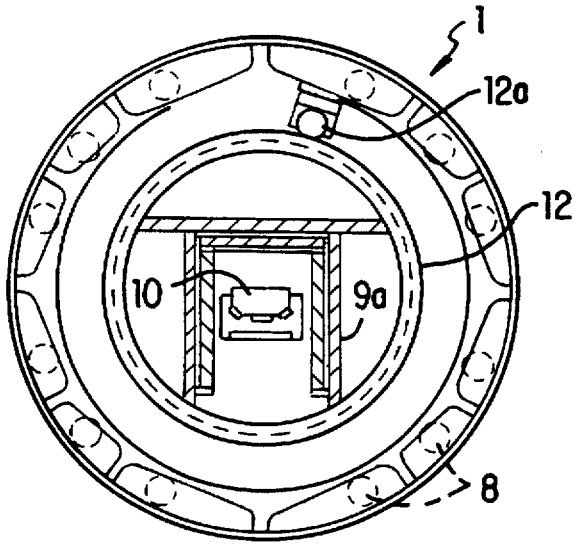
FIG. 2B is a cross-sectional view right side half part of which is taken on the line II—II of FIG. 1.

As shown in FIGS. 2A, and 2B the tunnel boring machine 1 has a pair of front grippers 6 each of which is mounted on the curved surface of the shield shell 2 in opposing to each other. Each of the front grippers 6 has a shoe 6*a* having an arc configuration in cross section and a gripper jack 6*b*. Each of the front grippers 6 is constructed in such a manner that the gripper jack 6*b* is adapted to make the shoe 6*a* move along the radial direction of the shield shell 2 by, for example, hydraulic pressure. That is, the shoe 6*a* is movable out of the shield shell 2 and movable thereinto.

A pair of front support members 7 is provided downward at the lower portion of the shield shell 2 for supporting the shield shell 2 therefrom. The front support member 7 has a structure for extending a shoe 7*a* for setting the shield shell 2 to a ground by a jack 7*b*. The pair of front support members 7 are constructed in such a manner that the jack 7*b* is adapted to make the shoe 7*a* move along a radial direction of the shield shell 2. The upper end of the jack 7*b* is pivotally supported with the lower portion of the bulk head 5 via a bracket 7*c*. A plurality of shield jacks 8, as second driving jacks, are provided in the shield shell 2, which are arranged with space from each other. The front end of the shield jack 8 is secured to the annular frame 2*a*, and the rear end of which is directed to the rear side of the tunnel boring machine 1.

Figure 3A:
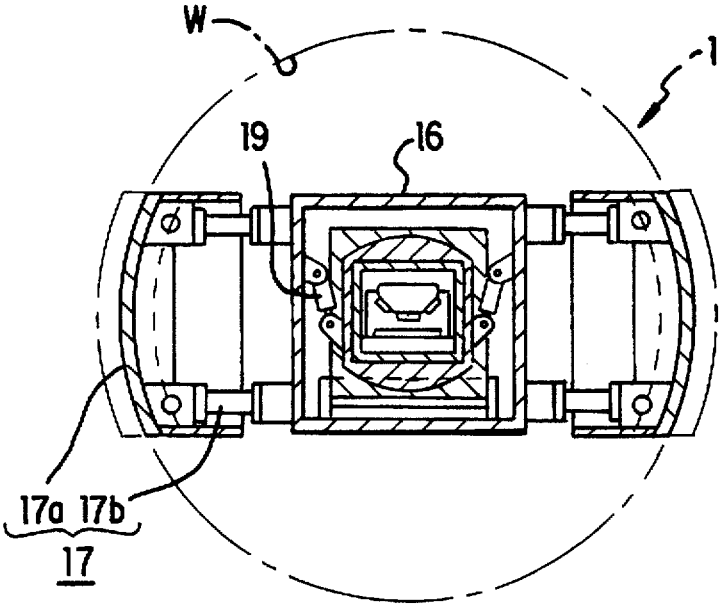
FIG. 3A is a cross-sectional view, left side half part of which is taken along the line III—III of FIG. 1.
Figure 3B:
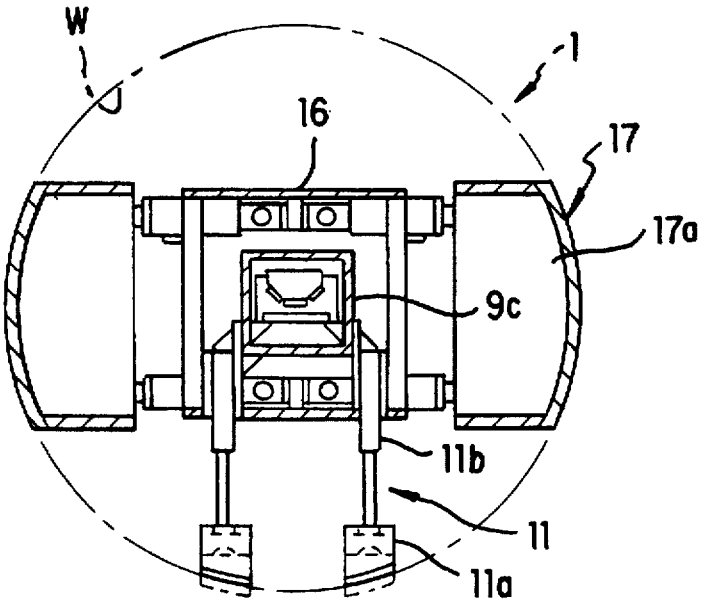
FIG. 3B is a cross-sectional view, right side half part of which is taken along the line IV—IV of FIG. 1.

Further, as shown in FIG. 1A, the tunnel boring machine 1 has a hollow main beam 9, the front end of which is fixed to the central portion of the bulk head 5. The main beam 9 is extended from the front body 1*a* towards the rear side of the tunnel boring machine 1. The main beam 9 is tapered to be gradually reduced from the front end thereof to the rear end thereof. The front portion 9*a* of the main beam 9 is formed as a rectangular frame, the configuration of which is rectangular, in cross section, as shown in FIGS. 2A, and 2B the lower end of the front portion 9*a* is opened. The rear portion 9*c* of the main beam 9 is formed as a square frame, the configuration of which is square, in cross section, as shown in FIGS. 3A, and 3B belt conveyor 10 is provided in the tunnel boring machine so as to extend from the cutter chamber 5a through the main beam 9 towards the rear side of the tunnel machine 1. In addition, the inner portion of the bulk head 5 is formed as a hollow portion, which is not shown, through which the belt conveyor 10 passes in the inner portion thereof. A pair of rear support members 11 are provided at the lower portion at the rear side of the main beam 9 for supporting the main beam 9 from the lower side thereof. The rear support member 11 has a structure for moving forward or backward a shoe 11*a* having an arc configuration in cross section for setting the main beam 9 to a ground by means of a jack 11*b*. That is, the pair of rear support members 11 are constructed in a manner that the jack 11*b* is adapted to make the shoe 11*a* move along the radial direction thereof.

Figure 4:
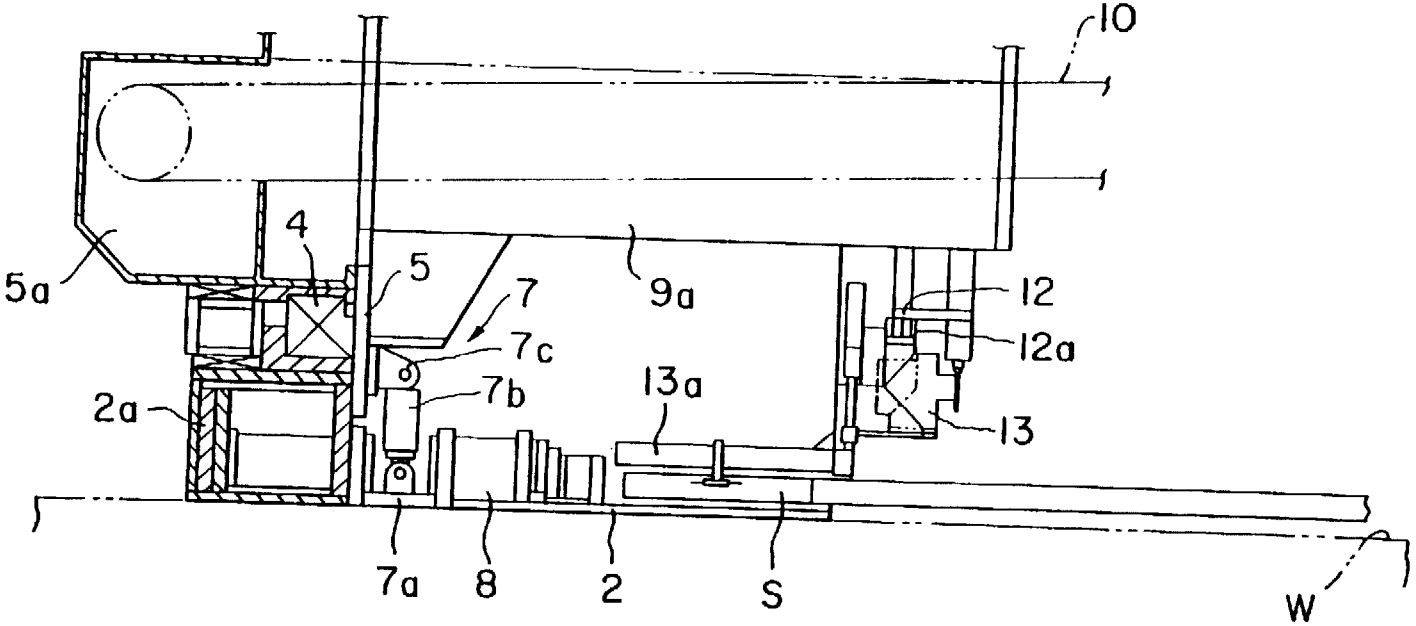
FIG. 4 is a fragmentary side view, on an enlarged scale, of a portion of the tunnel boring machine, i.e. the lower portion of the front body thereof, seen in FIG. 1.
Figure 5:
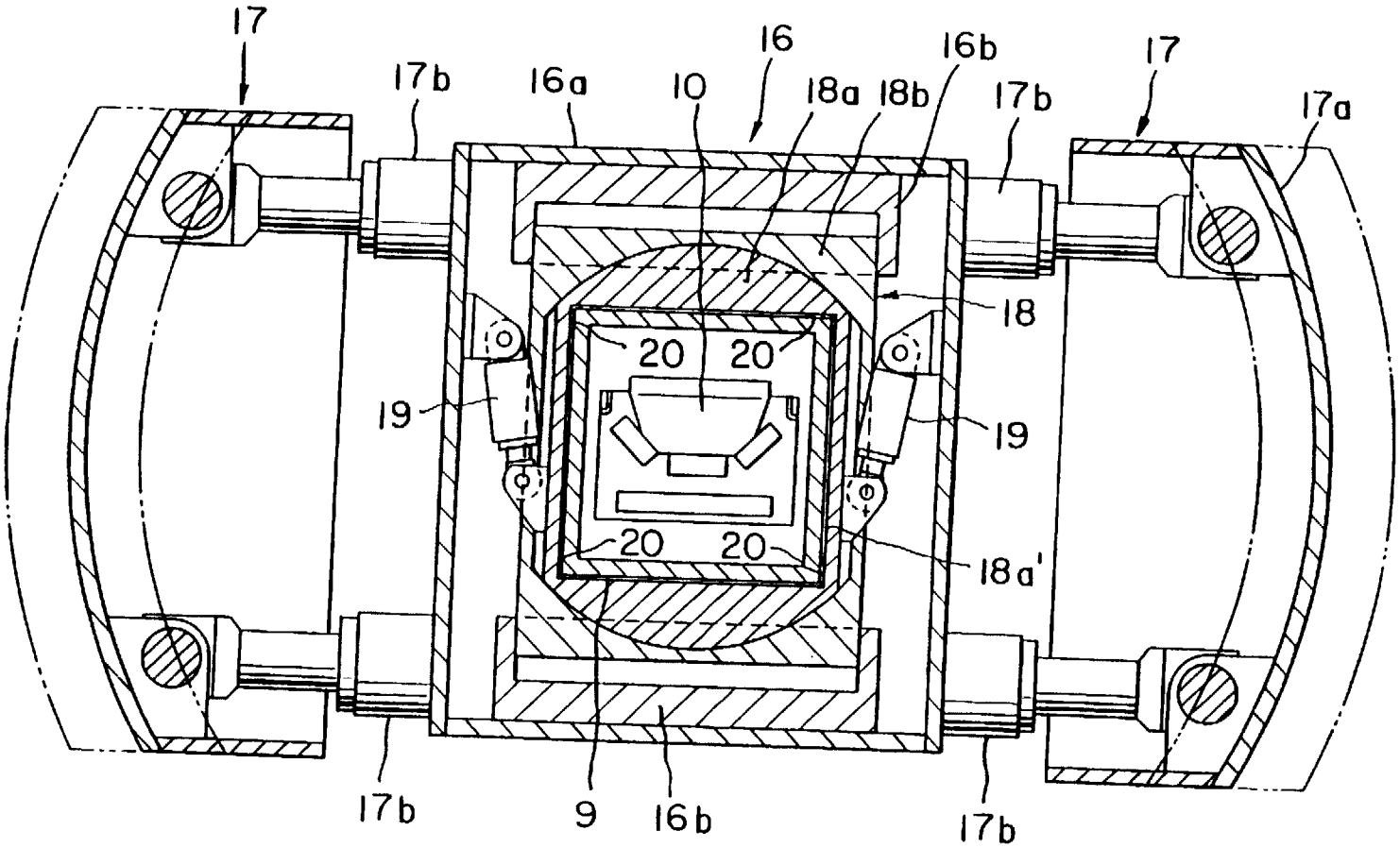
FIG. 5 is an enlarged cross-sectional view taken along the line V—V in FIG. 1.
Figure 6:
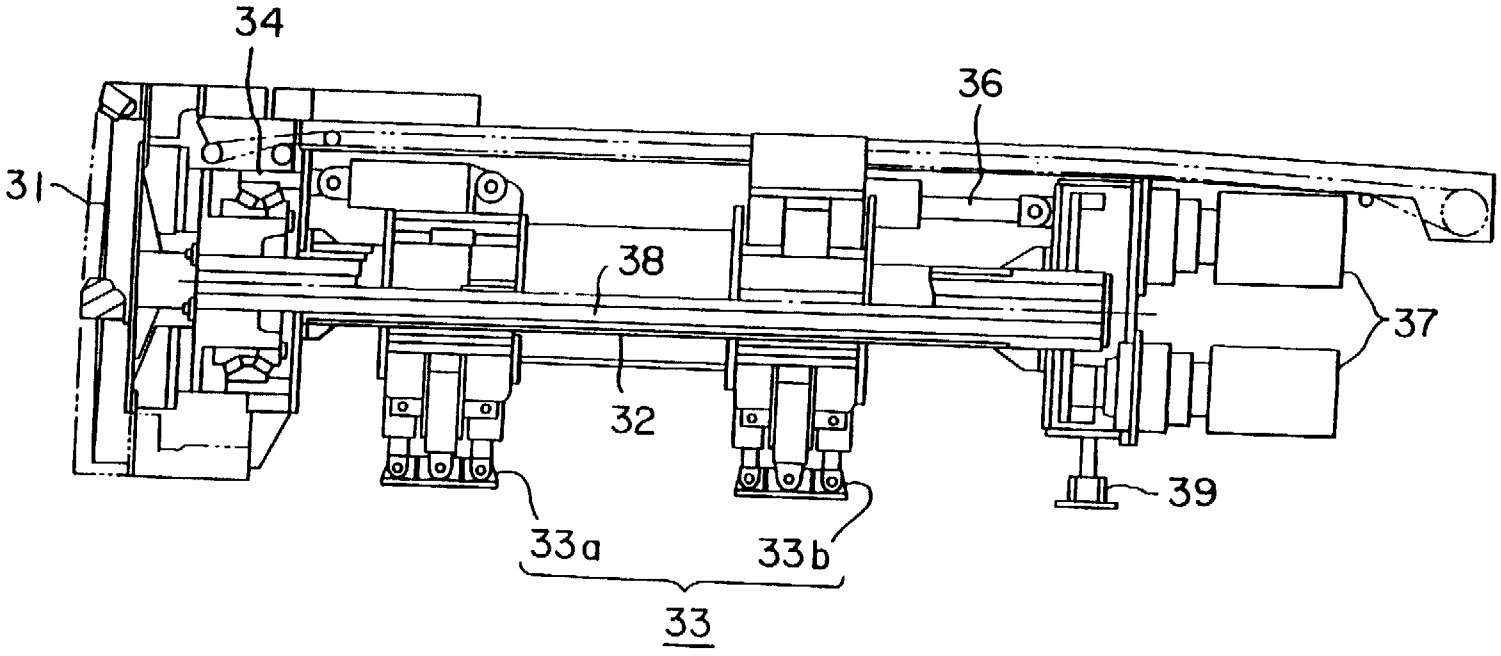
FIG. 6 PRIOR ART
FIG. 6 is a schematic side view showing a structure of a conventional common tunnel boring machine of a beam type (open type)
Figure 7:
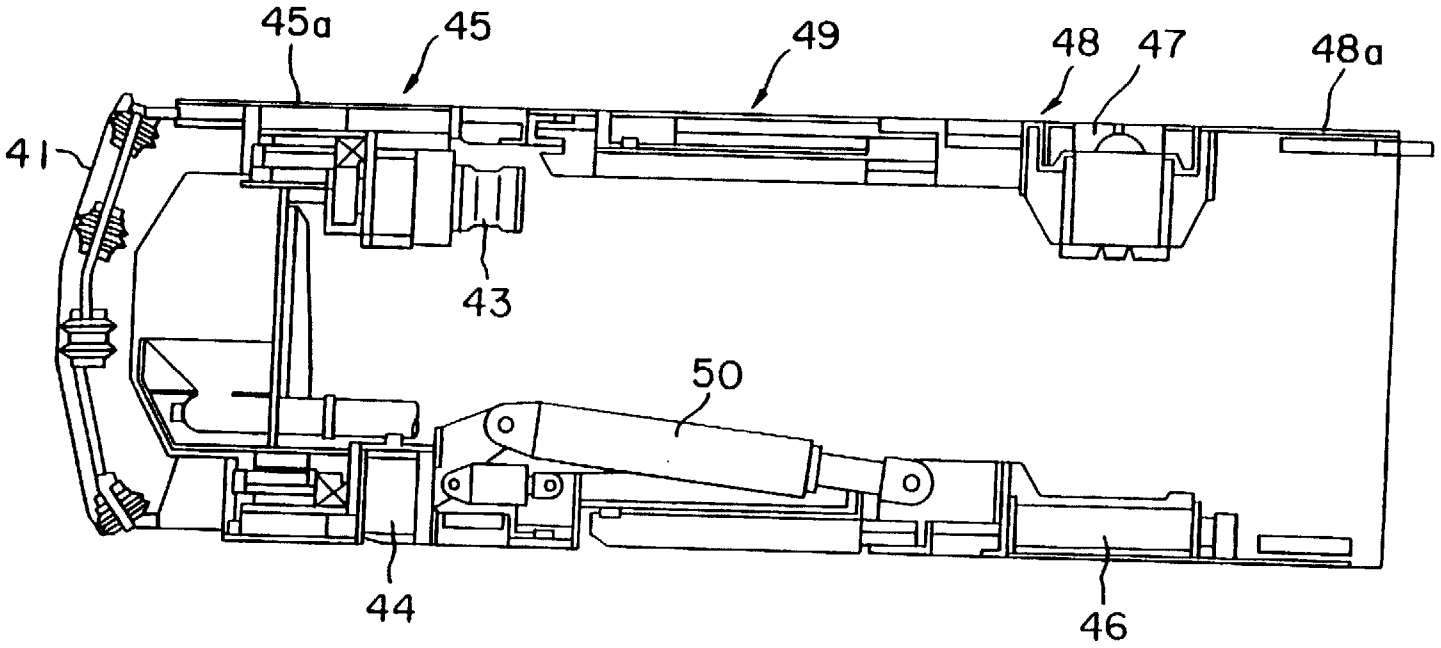
FIG. 7 PRIOR ART
FIG. 7 is a schematic side view showing a structure of a conventional common tunnel boring machine of a full-shield type.

A ring member 12 is mounted, as shown in FIGS. 3A, and 3B at the rear end of the front portion of the main beam 9. An erector 13 is provided, as shown in FIG. 1A, along the outer peripheral surface of the ring member 12 via a guide roll 12*a* to be rotatable around the axial direction of the ring member 12. The erector 13 is provided near the rear side of the shield shell 2 in an exposed manner, while, as shown in FIG. 4, a grasping unit 13*a* of a segment S is provided in the shield shell 2. A spray nozzle 14 is mounted at the rear end surface of the erector 13 via cylinder 14*a* so that the spray nozzle 14 moves along the radial direction of the ring member 12 (see FIG. 1). That is, the spray nozzle 14 is able to move out of the tunnel boring machine 1 and to move thereinto. The spray nozzle 14 can rotate with the erector 13 around the axial direction of the ring member 12 to a desired position along the periphery thereof. A gripper body 16 is slidably provided at the rear portion 9*c* of the main beam 9 along the axial direction thereof in a manner that the gripper body 16 supports the main beam 9 to be slidable along the axial direction. A pair of thrust jacks 15, as first driving jack, is provided near the main beam 9, the front end of the thrust jack 15 being pivotally supported and connected with the rear end of the front portion 9*a* of the main beam 9 via a vertical pin 15*a*. The rear end side of the thrust jack 15 rotates towards the outside. A pair of main grippers 17 are provided, as shown in FIG. 5, on either side of the gripper body 16, respectively. Each of the main grippers 17 has a gripper shoe 17*a* having an arc configuration in cross section and a plurality of gripper jacks 17*b*, each one end of which is connected with the either side of the gripper body 16, and the gripper shoe 17*a* is connected with other ends of the gripper jacks 17*b*, respectively. Each of the gripper jacks 17*b* can extend and shrink sidewards of the gripper body 16 by, for example, hydraulic pressure. Each of the main grippers 17 is constructed in such a manner that the extension and shrinkage of each of the gripper jacks 17*b* makes the gripper shoe 17*a* move sidewards of the gripper body 16 so as to press the gripper shoe 17*a* against a tunnel pile wall W. A rear end of the thrust jack 15, in this embodiment, is slidably urged to the gripper shoe 16 and is connected with the gripper shoe 17*a* of the main gripper 17 via a vertical pin 15*a*. Further, the rear end of the thrust jack 15 may be urged to the gripper body 16 and be connected therewith via a vertical pin 15*b*.

As shown in FIG. 5, the gripper body 16 is provided with a frame 16*a* square in cross section. Guide frames 16*b*, the configuration of which is U-shape in cross section, is provided on the opposing upper and lower surfaces of the frame 16*a* so as to project therefrom. A spherical bearing unit 18 is inserted in the upper and lower guide frames 16*b*, and the spherical bearing unit 18 is able to rise and fall. The spherical bearing unit 18 comprises an inner frame 18*a* which is provided at its upper and outer surface with spherical surface portions and a outer frame 18*b* which is provided at its upper inner surface with spherical surface seats, which are supported with the spherical surface portions of the inner frame 18*a* to be swingable in every direction. Torque jacks 19 are inserted to fit between the lower portions of both sides of the inner frame 18*a* and the upper portion of inner side surface of the frame 16*a* of the gripper body 16, respectively. Clearances are formed at both the side portions of the inner frame 18*a* and the outer frame 18*b*. The inner frame 18*a* is adapted to be swingable with respect to the outer surface 18*b* along the peripheral direction through the extension and shrinkage of the torque jacks 19. The inner frame 18*a* has an opening portion 18*a*', the configuration of which is square in cross section corresponding to the configuration of the outer sectional appearance of the rear portion 9*c* of the main beam 9. The main beam 9 and the gripper body 16 are slidably inserted to be fitted along the axial direction into the opening portion 18*a*' via slide metals 20 which are inserted at the inner corners of the opening portion 18*a*'. Moreover, the outer frame 18*b* having a square configuration is inserted to be fitted into the guide frame 16*b*.

Next, the boring work of the tunnel boring machine 1 in this embodiment will be described hereunder.

In the boring work of the tunnel in the hard ground, for example a rock-bed, the gripper shoes 17*a* of the main grippers 17 provided on either side of the gripper body 16 are pressed against the tunnel pile wall W so as to fix the gripper body 16 to the ground pile (tunnel pile wall W). In a state that the gripper body 16 is fixed, the thrust jack 15 is extended with the cutter head 3 rotated by means of the drive unit 21. As a result, the front body 1*a* advances so as to bore the tunnel. The main beam 9 slides forward against the inner frame 18*a* via the slide metals 20 in accordance with the advance of the front body 1*a*. After boring the tunnel by a predetermined distance, the shoe 6*a* is moved out of the shield shell 2 by the gripper jack 6*b* so as to be pressed against the tunnel pile wall W and to fix the front body 1*a* to the tunnel pile wall W. In a state that the front body 1*a* is fixed, the shoe 11*a* is moved downwards by the jack 11 so as to set the rear end side of the beam 9 to the ground and the shrinkage of the thrust jack 15 makes the gripper body 16 draw forward along the axial direction of the main beam 9 with the gripper shoes 17*a* of the main grippers 17 being shrunk by the gripper jacks 17*b* thereof. As a result, it becomes possible for the tunnel boring machine 1 to bore the tunnel. By repeating the boring work described above, the tunnel boring machine 1 is carried out the boring work successively completely.

A control of a boring direction of the tunnel with respect to the side direction of the tunnel boring machine 1, in other words, a control of a boring direction of the cutter head 3 is performed by inclining the main beam 9, the inclination of the main beam 9 being performed by utilizing stroke difference between the gripper jacks 17*b* of both the main grippers 17. A control of a boring direction of the tunnel regarding to the upper and lower directions of the tunnel boring machine 1 is performed by moving the shoes 7*a* of the pair of the front support members 7 out of the shield shell 2 and thereinto so as to swing the front body 1*a* to the upper and lower directions.

Furthermore, the rolling of the tunnel boring machine 1 caused at the boring working can be corrected by rotating the main beam 9 in the circumferential direction through the inner frame 18*a*, which is performed by adjusting the stroke of the torque jacks 19 disposed on both the sides of the gripper body 16. The main beam 9 can be moved only in the vertical direction through the spherical bearing unit 18 with respect to gripper body 16 by adjusting the strokes of both the torque jacks 19 in synchronism with each other. In addition, the inner frame 18*a* and the outer frame 19*b* of the spherical bearing unit 18 can be fixed to the desired positions at their spherical portions and the rotation torque caused through the rotation of the cutter head 3 can be supported with gripper body 16 via the main body 9 by keeping both the torque jacks with the predetermined strokes.

On the other hand, in the boring work of the tunnel in the soft ground, in a state that the shoe 6*a* of the front gripper 6 is shrunken so as to be drawn into the shield shell 2 and the gripper shoes 17*a* of the main grippers 17 are shrunken so as to be drawn to the gripper body 16, a reaction member, such as a surrounding wall of the segment S, is constructed by the erector 13, and the rear end of the shield jack 8 is urged to the end surface of the segment wall. While the cutter head 3 is rotated by the drive unit 21, the thrust forth produced by extending the shield jack 8 is given to the front body 1*a*. As a result, the front body 1*a* of the tunnel boring machine 1 advances so as to bore the tunnel. In this boring work, since the length of the shield shell 2 extending from the cutter head 2 towards the rear side of the cutter head 3 is short as compared with the length of the shield shell of the conventional tunnel boring machine in full-shield type, a supporting and protecting member is constructed to a portion rearside the cutting blade of the cutter head 3 by the elector 13 so as to cover the ground pile (the tunnel pile wall W) with the supporting and protecting member. Therefore, the collapse of the ground pile is able to be prevented. In addition, to move the spray nozzle 14 out of the tunnel boring machine 1 and to rotate with the erector 13 along the peripheral surface of the ring member 12 makes it possible to recover the ground pile by spraying a covering material thereon. Because the restoration work of the ground pile is carried out near the cutting blade, an earth and sand of the collapse of the ground pile can be prevented from falling on the main important devices of the tunnel boring machine 1, such as the main grippers 17, the thrust jack 15, and so on, which are exposed. As a result, these devices are not buried in the the earth and sand.

It is further understood by those skilled in the art that the foregoing description is made by way of preferred embodiment of the tunnel boring machine 1 illustrated in the accompanying drawings and that various changes and modifications may be made according to the present invention without departing from the spirit and scope of the appended claims.

What is claimed is:

1. A tunnel boring machine for boring a tunnel through ground, comprising:

a front body;

a cutter head rotatably mounted to the front body and having cutter means for boring a rock-bed;

a drive unit mounted to the front body for driving the cutter head;

a main beam connected to the front body and extending rearwardly therefrom;

a gripper body supported by the main beam slidably in an axial direction thereof;

a first thrust jack mounted between the main beam and the gripper body for thrusting the gripper body with respect to the main beam in a direction in which the gripper body moves apart from the front body and retracting the gripper body with respect to the main beam in a direction in which the gripper body approaches the front body;

a main gripper movably mounted to the gripper body in a radial direction of the gripper body for pushing against an inner wall of the bored tunnel in order to fix the position of the gripper body with respect to the bored tunnel;

a shield shell disposed on the front body, the shield shell extending rearwardly by a rear end position of the drive unit enough to cover the drive unit;

a front gripper mounted to the front body and movable out of and into the shield shell in a radial direction of the front body for pushing against the inner wall of the bored tunnel in order to fix the position of the front body with respect to the bored tunnel;

an erector mounted on the front body near a rear portion of the shield shell for disposing a supporting segment on an inner surface of the tunnel; and a second thrust jack mounted on the front body for thrusting the supporting segment disposed on the inner surface of the bored tunnel in order to move the front body ahead with respect to the bored tunnel.

2. The tunnel boring machine according to claim 1, further comprising a spherical bearing unit provided in the gripper body to allow the main beam to swing in every direction, and a torque jack mounted to be fitted between the gripper body and the spherical bearing unit for sliding the main beam in a vertical direction.

3. The tunnel boring machine according to claim 1, further comprising a front supporter extending downwardly from the front body, wherein the front gripper is disposed on each side portion of the shield shell.

4. The tunnel boring machine according to claim 3, wherein the front gripper is provided with a shoe and a gripper jack for moving the shoe outward the shield shell.

5. The tunnel boring machine according to claim 1, wherein a plurality of second thrust jacks are disposed in the shield shell in a circumferential direction thereof with space from each other.

6. The tunnel boring machine according to claim 1, wherein the main beam has a tapered configuration gradually reduced from the front body.

7. The tunnel boring machine according to claim 1, wherein the main gripper is provided with a gripper shoe and a gripper jack for moving the gripper shoe in a radial direction of the gripper body.

8. The tunnel boring machine according to claim 1, further comprising a ring member provided on the main beam, the erector is disposed along the ring member to be rotatable in a circumferential direction thereof.

9. A tunnel boring machine for boring a tunnel through a ground, comprising:

a front body;

a cutter head mounted to the front body and having cutter means for boring a rock-bed;

a drive unit rotatably supporting the cutter head for driving the cutter head;

a main beam operatively connected to the cutter head drive unit and extending rearward therefrom;

a gripper body supported by a rear end portion of the main beam to be slidable in an axial direction thereof and provided with a main gripper to be movable along a radial direction of the main beam;

a first thrust jack mounted to be fitted between the main gripper and the main beam for advancing the cutter head and the cutter head drive unit;

a shield shell disposed so as to surround said cutter head drive unit;

a second thrust jack disposed in the shield shell;

a front gripper mounted to the shield shell to be movable out of and into the shield shell; and a spherical bearing unit provided in said gripper body to allow the main beam to swing in every direction, and a torque jack mounted to be fitted between the gripper body and the spherical bearing unit for sliding the main beam in a vertical direction.

10. A tunnel boring machine for boring a tunnel through a ground, comprising:

a front body;

a cutter head mounted to the front body and having cutter means for boring a rock-bed;

a drive unit rotatably supporting the cutter head for driving the cutter head;

a main beam operatively connected to the cutter head drive unit and extending rearward therefrom;

a gripper body supported by a rear end portion of the main beam to be slidable in an axial direction thereof and provided with a main gripper to be movable along a radial direction of the main beam;

a first thrust jack mounted to be fitted between the main gripper and the main beam for advancing the cutter head and the cutter head drive unit;

a shield shell disposed so as to surround said cutter head drive unit;

a second thrust jack disposed in the shield shell;

a front gripper mounted to the shield shell to be movable out of and into the shield shell; and said main beam having a tapered configuration gradually reduced from the front body.

* * * * *

UNITED STATES PATENT AND TRADEMARK OFFICE

CERTIFICATE OF CORRECTION

PATENT NO. : 5,765,925 
DATED : June 16, 1998
INVENTOR(S) : Yasunori Kondo, Yuko Fukuda and Takato Yoshida It is certified that error appears in the above-identified patent and that said Letters Patent is hereby corrected as shown below:

Title page,
Item [22], Filed, "Apr. 10, 1996", change to -- Apr. 11, 1996 --
Item [56], References Cited, U.S. PATENT DOCUMENTS, insert the following:

| | | | |
|---|---|---|---|
| -- 5,125,719 | 6/1992 | Snyder | 299/31 |
| 3,493,165 | 2/1970 | Schonfeld | 299/31 |
| 3,963,080 | 6/1976 | Walker | 175/94 -- |

FOREIGN PATENT DOCUMENTS, insert the following:

| | | |
|---|---|---|
| -- 1282049 | 11/1968 | Germany |
| 2530988 | 12/1976 | Germany |
| 0451116 | 10/1991 | Europe |
| 0192847 | 9/1986 | Europe |
| 0054526 | 6/1982 | Europe -- |

Signed and Sealed this

First Day of April, 2003

JAMES E. ROGAN
*Director of the United States Patent and Trademark Office*